US006581240B2

(12) United States Patent
Kaffenberger

(10) Patent No.: US 6,581,240 B2
(45) Date of Patent: Jun. 24, 2003

(54) BRUSH ATTACHMENT FOR VACUUM CLEANERS

(75) Inventor: Dieter Kaffenberger, Wiehl (DE)

(73) Assignee: Wessel-Werk GmbH, Reichshof-Wildbergerhutte (DE)

( * ) Notice: Subject to any disclaimer, the term of this patent is extended or adjusted under 35 U.S.C. 154(b) by 0 days.

(21) Appl. No.: 10/039,756

(22) Filed: Nov. 9, 2001

(65) Prior Publication Data

US 2002/0108210 A1 Aug. 15, 2002

(30) Foreign Application Priority Data

Nov. 24, 2000 (CN) ..... 00 128 320

(51) Int. Cl.[7] ..... A47L 5/10
(52) U.S. Cl. ..... 15/387; 15/377
(58) Field of Search ..... 15/377, 387

(56) References Cited

U.S. PATENT DOCUMENTS 5,249,333 A * 10/1993 Worwag ..... 15/387
5,293,665 A * 3/1994 Worwag ..... 15/387
5,345,650 A * 9/1994 Downham et al. ..... 15/331
5,950,275 A * 9/1999 Worwag ..... 15/387
6,151,752 A * 11/2000 Melzner et al. ..... 15/387
6,209,169 B1 * 4/2001 Dilger et al. ..... 15/387
6,513,190 B1 * 2/2003 Allgeier et al. ..... 15/387

FOREIGN PATENT DOCUMENTS

DE 41 05 336 10/1992
EP 0 338 780 10/1998

* cited by examiner

*Primary Examiner*—Terrence R. Till
(74) *Attorney, Agent, or Firm*—Collard & Roe, P.C.

(57) ABSTRACT

A brush attachment for vacuum cleaners comprises a housing consisting of a bottom part and a top part, a turbine wheel driven by the suction air stream, a brush roller driven by the turbine wheel, and a suction tube connection constructed in the form of a swivel/tilting joint. The brush roller is disposed in a brush roller chamber which has a bottom opening constructed as a suction orifice. The turbine wheel is disposed in a turbine chamber with a connection duct of the swivel/tilting joint. The duct is pivotable about the turbine wheel. The bottom part of the housing has webs which form the back wall of the brush roller chamber and the side walls of the turbine chamber and define a flow chamber. A nozzle made as a separate part is inserted in the flow chamber and contains an incident flow duct for alignment of the suction air stream flowing against the turbine wheel. The top part of the housing has connection webs which bear against the webs and against the top of the nozzle.

6 Claims, 4 Drawing Sheets

BRUSH ATTACHMENT FOR VACUUM CLEANERS

BACKGROUND OF THE INVENTION

1. Field of the Invention

The invention relates to a brush attachment for vacuum cleaners, comprising a housing consisting of a bottom part and a top part, a turbine wheel driven by a suction air stream, a brush roller driven by the turbine wheel, and a suction tube connection constructed in the form of a swivel/tilting joint. The brush roller is disposed in a brush roller chamber which has a bottom opening constructed as a suction orifice, and the turbine wheel is disposed in a turbine chamber with a connection duct of the swivel/tilting joint. The duct is pivotable about the turbine wheel.

2. The Prior Art

A brush attachment of the construction described is known, for example, from EP 0 338 760 A2. The suction air stream passes through a duct which connects the brush roller chamber to the turbine chamber, into the turbine chamber and is directed tangentially on to the turbine wheel, which is constructed as a Pelton wheel. In a construction known from DE 41 05 336 C2, a connecting duct is provided between the brush roller chamber and the turbine chamber and has an end member aligned radially to the turbine wheel. The suction air stream flows through the interior of the turbine wheel, which has blading open to the interior.

The duct leading into the turbine chamber is dependent on the type and size of the turbine wheel. The duct cross-section has to be adapted to the suction air flow and hence also to the suction capacity of the vacuum cleaner which is to be connected thereto. If the brush attachment is operated in conjunction with a vacuum cleaner the suction capacity of which differs from the values taken as a basis in designing the brush attachment, the turbine wheel does not operate with optimal efficiency.

SUMMARY OF THE INVENTION

Against this technological background, the object of the invention is to provide a brush attachment in which the incident flow is variable in a very simple manner and can be adapted to the suction capacity of the vacuum cleaner which is to be connected thereto.

To this end, in a brush attachment according to the invention, the bottom part of the housing has webs which form the back wall of the brush roller chamber and the side walls of the turbine chamber and define a flow chamber. A nozzle made as a separate part is inserted in the flow chamber and contains an incident flow duct for alignment of the suction air stream flowing against the turbine wheel, and the top part of the housing has connection webs which bear against the webs and against the top of the nozzle.

The incident flow to the turbine wheel can be changed very simply and effectively by changing the nozzle. As a result, it is possible to equip the brush attachment with different turbine wheels with optimal incident flow being ensured in each case. In particular, the duct cross-section can be adapted to the suction capacity of the vacuum cleaner which is to be connected thereto. The brush attachment can be operated with vacuum cleaners of different manufacturers with optimal turbine efficiency in each case.

According to a preferred embodiment of the invention, the nozzle rests on a base surface of the bottom part of the housing, has a wall surface which is curved in the form of an arc of a circle with respect to the turbine chamber, and contains as an incident flow duct a recess which extends as far as the base surface of the bottom part of the housing. Advantageously, the nozzle is guided laterally at the chamber-forming webs of the bottom part of the housing and is additionally fixed by positive engagement configurations on the base surface of the bottom part of the housing.

The top part of the housing can have an opening for external air and a shut-off device for metering the external air flow. In a further development according to the invention, the nozzle has an external air duct open towards the top of the nozzle and an outlet on the edge side leading to the brush roller chamber or to the incident flow duct leading into the turbine chamber. In this construction, the nozzle simultaneously forms a flow insert for guiding the external air introduced into the brush attachment. In a constructively preferred embodiment, the shut-off device is constructed as a slide which is movable in front of the nozzle outlet adjacent the wall.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
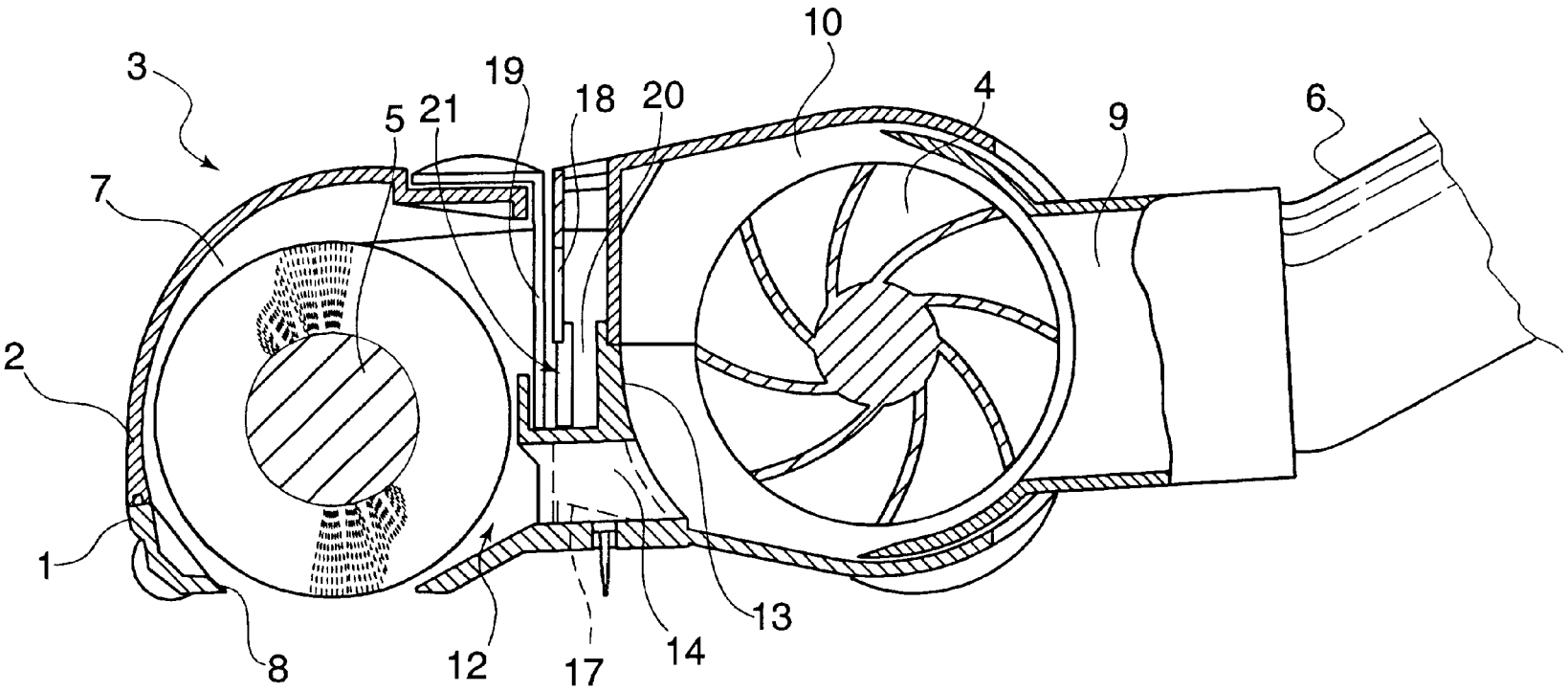
FIG. 1 shows a diagrammatic longitudinal section through a brush attachment according to the invention.

The basic structure of the brush attachment shown in FIG. 1 comprises a housing 3 consisting of a bottom part 1 and a top part 2, a turbine wheel 4 driven by the suction air stream, a brush roller 5 driven by the turbine wheel, and a suction tube connection 6 constructed in the form of a swivel/tilting joint. The brush roller 5 is disposed in a brush roller chamber 7 which contains a bottom opening constructed as a suction orifice 8. The turbine wheel 4 is disposed in a turbine chamber 10 with a connecting duct 9 of the swivel/tilting joint, said duct 9 being pivotable about the turbine wheel 4.

Figure 2:
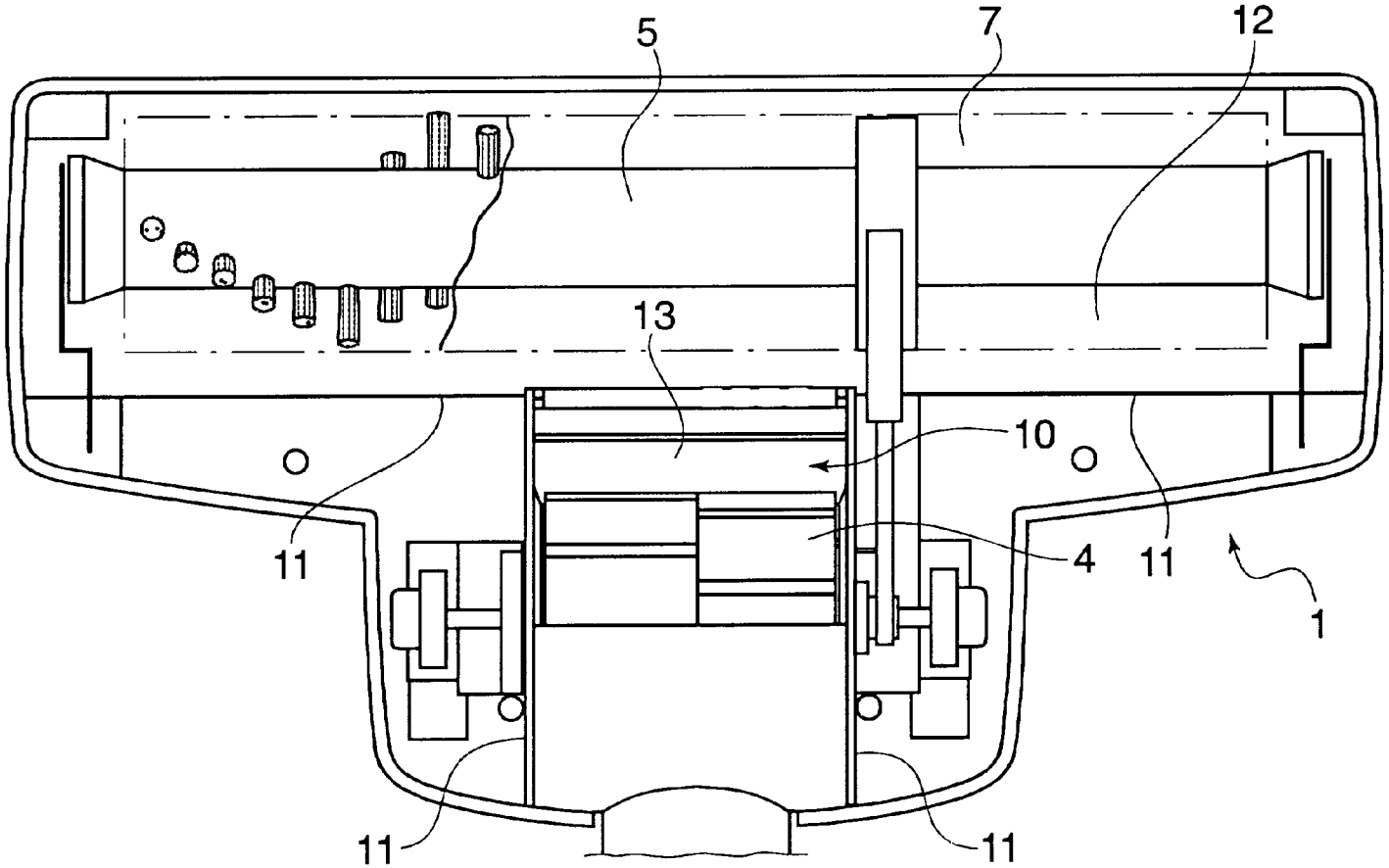
FIG. 2 shows a diagram showing the inside of the bottom part of the housing.
Figure 3:
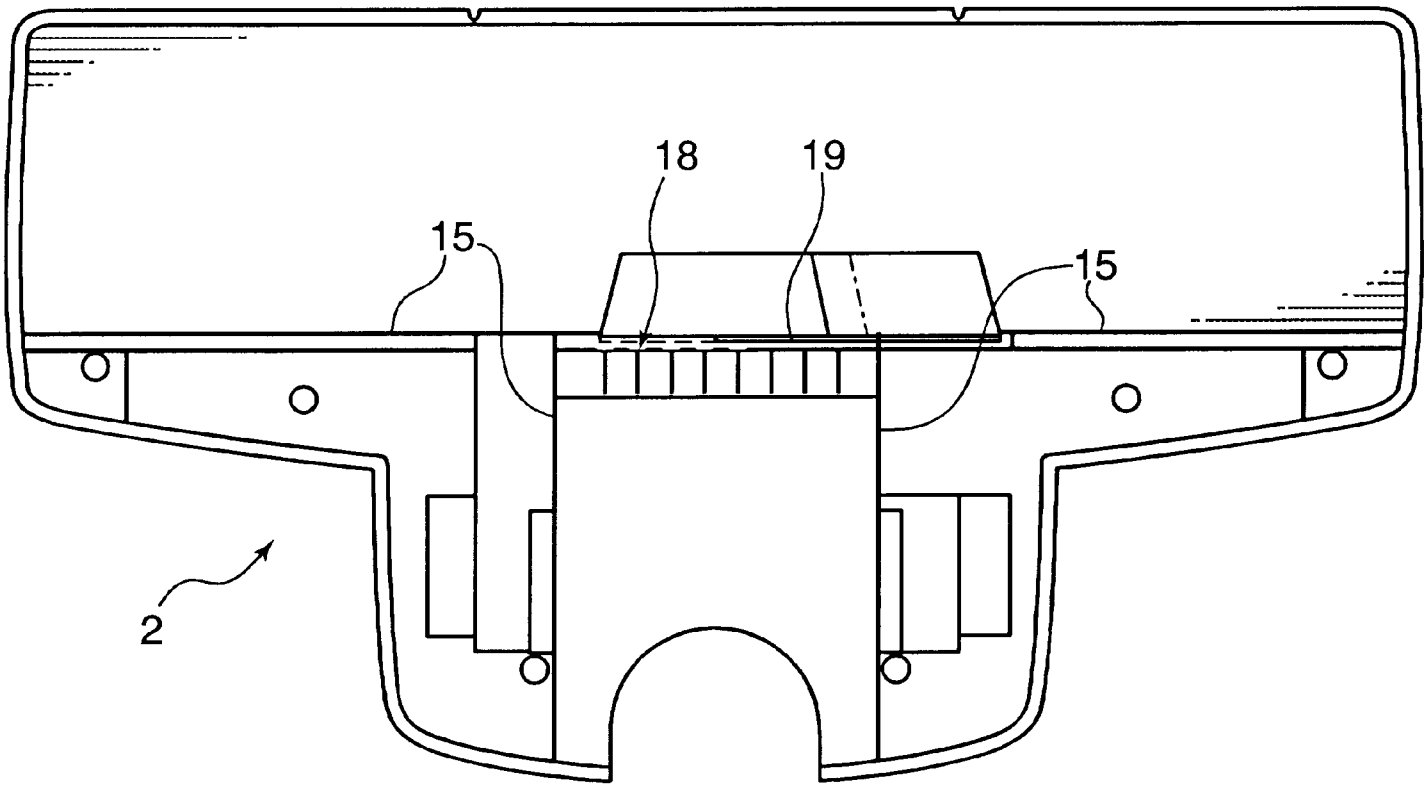
FIG. 3 is a diagram showing the inside of the top part of the housing.

FIG. 2 shows that the bottom part 1 of the housing has webs 11 which form the back wall of the brush roller chamber 7 and the side walls of the turbine chamber 10, and define a flow chamber 12. The nozzle 13 shown in FIG. 4 can be inserted into the flow chamber 12. It is made as a separate part and contains an incident flow duct 14 for alignment of the suction air stream flowing against the turbine wheel 4. The top part 2 of the housing shown in FIG. 3 comprises connecting webs 15 which bear against the webs 11 and against the top of the nozzle 13.

Figure 4:
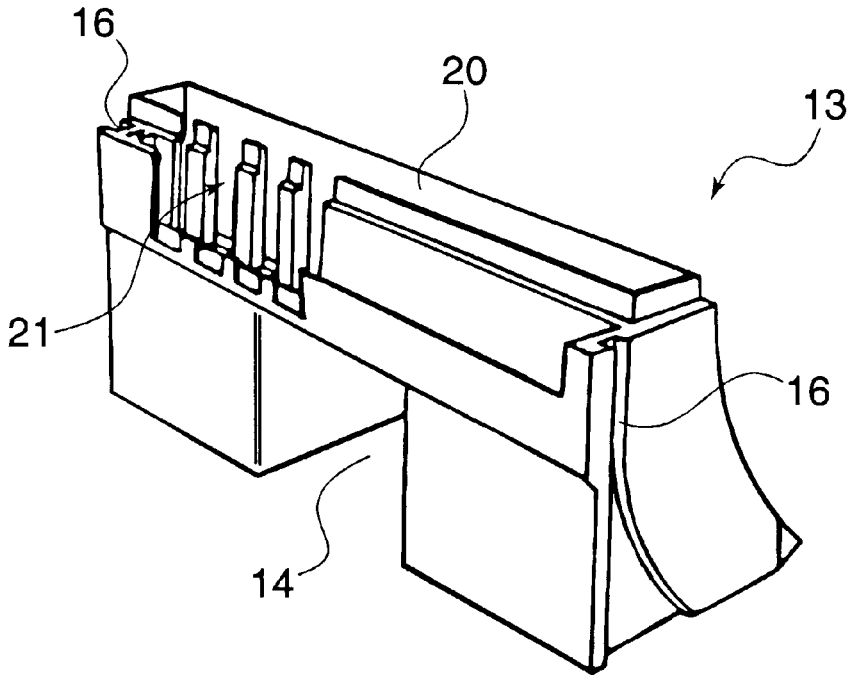
FIG. 4 shows an interchangeable nozzle for the article shown in FIG. 1.

A comparison of FIGS. 1 and 4 indicates that the nozzle 13 rests on a base surface of the bottom part 1 of the housing, has a wall surface which is curved in the form of an arc of a circle in relation to the turbine chamber 10, and as an incident flow duct 14 contains a recess which extends as far as the base surface of the bottom part 1 of the housing. The nozzle 13 is guided laterally at the chamber-forming webs 11 of the bottom part 1 of the housing and for this purpose has a guide groove 16 in which engages in each case a projection integrally formed on webs 11. To simplify assembly, the lateral guide groove 16 is widened in the downward direction. Nozzle 13 is further fixed in the base surface of the bottom part 1 of the housing by positive connection configurations 17. In the exemplified embodiment, the positive engagement configurations 17 are in the form of projections which are formed on the base surface of bottom part 1 of the housing and which engage in recesses of the nozzle 13 adjacent the bottom. Nozzle 13 is clamped and held positively between bottom part 1 of the housing and top part 2 thereof. There is no need for a glued connection, although this is not impossible.

Top part 2 of the housing has an opening 18 for external air and a shut-off device 19 for metering the quantity of external air. The shut-off device 19 is in the form of a slide. It will be seen from a comparison of FIGS. 1 and 4 that nozzle 13 has an external air duct 20 which is open towards the top of the nozzle and which has adjacent the wall an outlet 21 leading to the brush roller chamber 7. Slide 19 is movable in front of the outlet 21 of nozzle 13 adjacent the wall.

Accordingly, while only a few embodiments of the present invention have been shown and described, it is obvious that many changes and modifications may be made thereunto without departing from the spirit and scope of the invention.

What is claimed is:

1. A brush attachment for vacuum cleaners comprising:

a housing consisting of a bottom part and a top part;

a turbine wheel driven by a suction air stream and disposed in a turbine chamber within the housing;

a brush roller driven by the turbine wheel, said brush roller being disposed in a brush roller chamber within the housing, said brush roller chamber having a bottom opening constructed as a suction orifice; and a suction tube connection constructed in the form of a swivel/tilting joint connected to the turbine chamber via a connection duct;

wherein the bottom part of the housing has webs which form the back wall of the brush roller chamber and the side walls of the turbine chamber and define a flow chamber, and wherein a separate nozzle is inserted in the flow chamber and contains an incident flow duct for alignment of the suction air stream flowing against the turbine wheel, and the top part of the housing has connection webs which bear against the chamber-forming webs and against the top of the nozzle.

2. A brush attachment according to claim 1, wherein the nozzle rests on a base surface of the bottom part of the housing, and has a wall surface which is curved in the form of an arc of a circle with respect to the turbine chamber, and contains as an incident flow duct a recess which extends as far as the base surface of the bottom part of the housing.

3. A brush attachment according to claim 2, wherein the nozzle is guided laterally at the chamber-forming webs of the bottom part of the housing.

4. A brush attachment according to claim 1, wherein the nozzle is fixed by positive engagement configurations on the base surface of the bottom part of the housing.

5. A brush attachment according to claim 1, wherein the top part of the housing has an opening for external air and a shut-off device for metering the quantity of external air and wherein the nozzle has an external air duct which is open at a top of the nozzle, said air duct having an outlet adjacent the wall; said outlet leading to the brush roller chamber or to the incident flow duct leading into the turbine chamber.

6. A brush attachment according to claim 5, wherein the shut-off device is constructed as a slide which is movable in front of the outlet of the nozzle adjacent the wall.

* * * * *